US005348249A

United States Patent [19]

Gallivan

[11] Patent Number: 5,348,249

[45] Date of Patent: Sep. 20, 1994

[54] RETRO REFLECTION GUIDANCE AND CONTROL APPARATUS AND METHOD

[75] Inventor: James R. Gallivan, Pomona, Calif.

[73] Assignee: Hughes Missile Systems Company, Los Angeles, Calif.

[21] Appl. No.: 4,163

[22] Filed: Jan. 11, 1993

[51] Int. Cl.[5] ..... F41G 7/00

[52] U.S. Cl. ..... 244/3.11

[58] Field of Search ..... 244/3.11, 3.13, 3.14, 244/3.16; 342/62; 356/152

[56] References Cited

U.S. PATENT DOCUMENTS

| | | | |
|---|---|---|---|
| 2,404,942 | 7/1946 | Bedford | 244/3.13 |
| 3,398,918 | 8/1968 | Girault | 244/3.13 |
| 3,416,751 | 12/1968 | Larson | 244/3.13 |
| 3,501,113 | 3/1970 | Maclusky | 244/3.13 |
| 3,690,594 | 9/1972 | Menke | 244/3.13 |
| 3,782,667 | 1/1974 | Miller et al. | 244/3.13 |
| 3,796,396 | 3/1974 | Crovella | 244/3.14 |
| 3,860,199 | 1/1975 | Dunne | 244/3.13 |
| 4,149,686 | 4/1979 | Stauff et al. | 244/3.16 |
| 4,157,544 | 6/1979 | Nichols | 343/5 GC |
| 4,234,141 | 11/1980 | Miller et al. | 244/3.13 |
| 4,300,736 | 11/1981 | Miles | 244/3.13 |
| 4,433,818 | 2/1984 | Coffel | 244/3.13 |
| 4,634,271 | 1/1987 | Jano et al. | 356/5 |
| 4,732,349 | 3/1988 | Maurer | 244/3.13 |

FOREIGN PATENT DOCUMENTS

| | | |
|---|---|---|
| 239156 | 9/1987 | European Pat. Off. . |
| 1431262 | 10/1969 | Fed. Rep. of Germany . |
| 2157672 | 5/1973 | Fed. Rep. of Germany . |
| 2082867 | 3/1982 | United Kingdom . |

*Primary Examiner*—Daniel T. Pihulic

*Attorney, Agent, or Firm*—Charles D. Brown; Randall M. Heald; Wanda K. Denson-Low

[57] ABSTRACT

A retro reflection guidance and control system for a projectile, and a method of obtaining flight characteristics and controlling the projectile. A launch platform based transmitter/receiver and processor sends signals to a projectile, which signals are received at the back thereof. The transmitted signals are selectively reflected, to provide flight characteristic information to the transmitter/receiver, and detected to provide flight control information to the projectile.

7 Claims, 3 Drawing Sheets

RETRO REFLECTION GUIDANCE AND CONTROL APPARATUS AND METHOD

FIELD OF THE INVENTION

This invention relates generally to projectile flight, and more particularly to a method and apparatus for determining projectile flight characteristics in real time and for modifying some of those characteristics for a rolling projectile.

BACKGROUND OF THE INVENTION

Many things can happen between firing or launching of a projectile and the eventual completion of its flight. It may simply be "spent" or it may be intended to hit or come into close proximity with a target. It may be intended to explosively damage or disable the target.

If the projectile is simply aimed, fired and travels ballistically, with no flight information detection or control being exercised, there is little more to do but aim and fire until the desired results are achieved. If the projectile is controllable to some extent, or if flight characteristic information is desired, other factors come into play. Flight information may be obtained from radar or by information from an onboard transmitter to a receiver on a remote platform. There may be an active guidance system on board the projectile which could include an active transmitter/receiver system. There may be other types of signal exchange between the projectile and a remote platform associated with the launch site, or between the projectile and the target. Many of these signal transmissions or exchanges could be subject to countermeasure efforts to deflect the projectile from its intended path.

SUMMARY OF THE INVENTION

Broadly speaking, this invention provides a method and apparatus, including an active transmitter of signals, to detect roll phase, roll rate and pitch attitude of a rolling projectile, thereby allowing the projectile to be guided with minimal onboard guidance structure.

More specifically, the invention provides an inexpensive, passive retro reflector to be mounted on the back of a projectile and provide information on absolute roll phase, roll rate, and relative attitude of the projectile body. The retro reflector, in combination with the system and method of this invention, can be employed even on a very small projectile. The same optical area used for the retro reflector may also be used to collect coded signals for use in guidance of the projectile. Only passive detection or receiving means are carried onboard the projectile.

Because signals are reflected backward from the projectile and those signals are not of predetermined phase, the entire projectile guidance system is countermeasure robust.

The passive retro reflector is preferably comprised of a collecting lens, a reticle having a pattern of reflective and transmissive areas, a detector, and a processor, all located within and forwardly of the back end of the projectile. A single channel communication system provides signals to the projectile, some of which are reflected with information as to flight characteristics of the projectile, and some of which are passed on to the detector in the projectile. Those signals may contain directive information which causes the projectile to change its flight characteristics.

The same receiver/reflector system could be positioned on the front of a projectile so that it could be detected when approaching the transmitter/receiver platform.

The signal beam from the transmitter/receiver could be as much as ten degrees wide, for example, thereby enabling the same beam to control several projectiles at different distances and locations but within the cone of the beam.

In an alternative embodiment, a Luneburg spherical lens having selective reflective and detector segments on the inner hemisphere, would replace the lens, reticle and detector of the first embodiment.

BRIEF DESCRIPTION OF THE DRAWING

The objects, advantages and features of this invention will be more readily perceived from the following detailed description, when read in conjunction with the accompanying drawing, in which.

DESCRIPTION OF THE PREFERRED EMBODIMENTS

Figure 1:
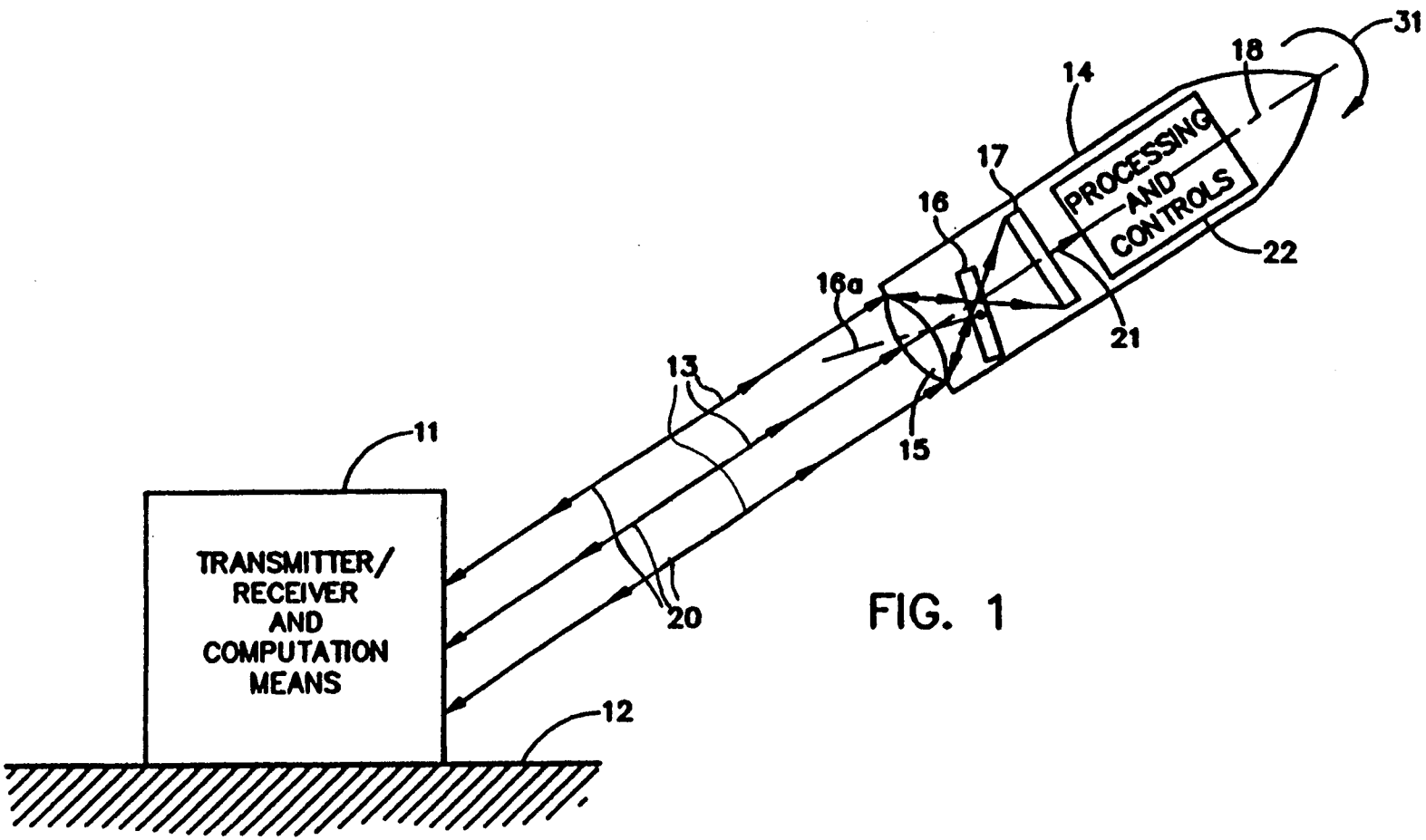
FIG. 1 is a schematic view of the invention showing a projectile at a location remote from the transmitter/-receiver.
Figure 2:
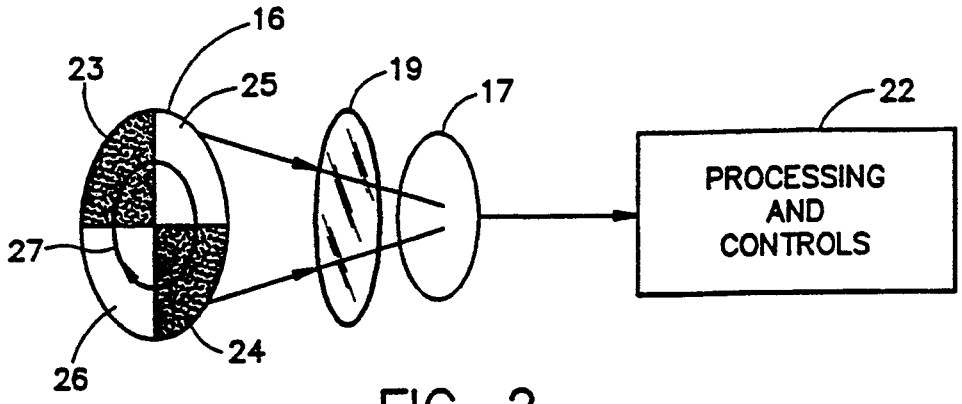
FIG. 2 is an enlarged schematic view of a portion of the signal processing portion of the invention of FIG. 1.

With reference now to the drawing, and more particularly to FIGS. 1 and 2 thereof, there is shown transmitter/receiver 11 on a platform 12 which may be the ground, a ship, an aircraft or a vehicle of any other type, transmitting signals by means of a beam of energy 13 to projectile 14. In the back end of projectile 14 is collecting lens 15, reticle 16 and detector 17. Between the reticle and the detector may optionally by placed a filter 19, which will be discussed below. The output 21 of detector 17 is coupled to processing and controls block 22 which receives, processes, and reacts in a predetermined manner to signals from transmitter/receiver 11.

The reticle, filter, detector and processor are shown in enlarged and partial perspective form in FIG. 2. The reticle is shown having alternately opaque or reflective segments 23 and 24 spaced by transmissive segments 25 and 26. The energy from the transmitter/receiver focused by lens 15 is represented by focused energy ring 27.

Signals in any form desired are transmitted from transmitter/receiver 11 along beam 13 to rolling projectile 14, the roll being indicated by arrow 31. The energy from the transmitter reaches the back of the projectile and is received at collecting lens 15 and passed to reticle 16. The reticle has a pattern thereon of reflective and transmissive segments in any desired form. The reticle is located at the focal plane of lens 15 but is offset in angle from projectile roll axis 18. Any signals that are transmitted through reticle 16 are received by detector 17 which generates a signal responsive to the received energy which is passed on to processor 22.

When signals from the transmitter are focused on a reflecting portion (23, 24) of the reticle, the signal is reflected back to the lens which collimates it as it proceeds back to the receiver portion of the transmitter/-receiver as energy beam 20. The receiver detects the energy retro reflected from the projectile and appropriate processing is then accomplished. This retro reflection is quite efficient; it makes the cross section of even a very small projectile large and easy to detect.

The entire optics and signal processing portion of the invention in projectile 14 is fixed with respect to the projectile. Note that reticle 16 and its optics centerline **16*a* are on a tilt, or canted, that is, the reticle plane is not perpendicular to center line or roll axis 18** of the projectile. This causes the transmitted energy to move in a circle with respect to the reticle pattern at the angular radius of the projectile/optical alignment angle and at a frequency of the projectile roll rate. The circular energy pattern on the reticle causes reflected energy to return to the transmitter/receiver when the energy impinges on a reflective part of the reticle. Knowing the reticle pattern, the modulations over a roll period yield rotational phase of the projectile when the retro reflected energy reaches the receiver. Pitch attitude of the projectile is obtained from the frequency and phase content of the returned signal. Of course, it is a simple matter for the transmitter/receiver to calculate distance between it and the projectile and also to derive speed from the information available from the reflected signal.

More graphic representations of the modulated return signals are shown in FIGS. 5–8. The signal and projectile axes are aligned in FIG. 5, with resulting modulated reflected waveform 41 in FIG. 6. Note that with an aligned and centered reticle, the modulated return signal is a regular square wave. When the reticle center is offset from the projectile axis and the signal axis, the return signal is phase modulated. It is a simple matter for a processor in transmitter/receiver 11 to determine attitude offset by the quality of the modulation of waveform 42. The direction of offset may be determined by the phase of the center of the widest pulse 43. Note that circular signal path 27 is offset with respect to the reticle center in FIG. 8. The radius of path 27 is determined by the angular offset between the projectile roll axis and the optics/reticle axis.

The information retro reflected from the reticle is important because it allows guidance or other command signals to be computed at the transmitter/receiver site and relayed back to the projectile. It is contemplated that flight characteristic commands will be relayed to the projectile by means of transmitter signal carrier modulation.

When the signals of the focused energy ring are coincident with a transmissive part (25, 26) of the reticle pattern, it will pass on to detector 17. These received signals would then be amplified, detected and processed to remove command information from the carrier. The detected signals would then be used for guidance and control of the projectile.

It is contemplated that the projectile can be something as small as a bullet, at approximately one half inch in diameter, and is particularly adaptable to any projectile on up to and larger than, a four inch shell. Even a small bullet may have a single one-time correcting vane or explosive charge to make a one-shot correction. This vane or charge would likely be located near the center of gravity and would cause the desired change in direction or flight characteristics of the projectile in response to a signal from the transmitter/receiver. It is also possible that there would be no active control on the projectile, but the information received by the retro reflection system could be valuable because it would enable the operator at the platform to obtain full information on the bullet or projectile for test or other purposes. This would provide full and accurate trajectory and spin rate information. As the diameter and size of the projectile to which the retro reflection system of this invention is mounted increases, more control surfaces and more precise changes to the flight characteristics may be made. However, it should be recognized that the retro reflection system in a projectile in accordance with this invention is a passive system, and only makes changes in the projectile pursuant to received information. It does not transmit signals.

Figure 9:
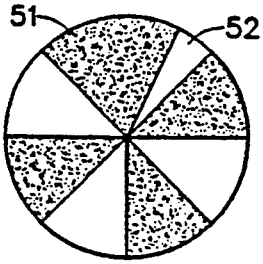
FIG. 9 shows a modified version of the reticle of FIG. 2 to facilitate determining roll phase and roll rate.

Possible uses and advantages of the system are that by means of the active launch platform based transmitter/-receiver (with processor) and the passive retro reflection system in the projectile, it is relatively straightforward to determine roll phase, roll rate and pitch attitude of the projectile, including for a very small projectile such as a bullet, as discussed above. With the tilted reticle with respect to the spin axis, the reflected signal is both chopped and frequency modulated, thereby providing the information necessary for a computer in the transmitter/receiver to determine pitch attitude. Of course, it is relatively simple to determine roll phase, since there need only be a simple key or marker, such as a different size reflective segment 51 on reticle 52 as shown in FIG. 9. By this means the particular rotational orientation of the projectile in space can be easily determined at any time.

Countermeasures with respect to such a projectile would also be relatively difficult because the projectile receives and retro reflects information only from a small cone at the back. This is at least partially because the projectile is not actively transmitting and the reflected signals only return toward the transmitter, which is normally at the origin of the flight of the projectile, thereby making it necessary for countermeasures to originate in the vicinity of the transmitter/-receiver, a situation which is relatively unlikely.

There are instances where the optics and reticle receiver/reflector could be mounted at .the front of a projectile to guide the projectile toward that which it is approaching. This is contemplated as an exception to the preferred embodiment, but it could work in the same way, but most likely for different purposes.

Another advantage of the system is that one transmitter/receiver can track and control numerous projectiles simultaneously, employing range differences, different reticle patterns and projectile receiver codes to provide individual control. While the beam transmitted by the transmitter/receiver is quite directional, it could be as much as ten degrees wide, for example, and could potentially thereby include a relatively large number of projectiles within the ten degree cone. Thus the tracking and control of numerous projectiles simultaneously would be rather easily accomplished.

It is also possible that, with roll phase information, directional warheads could be fired with the correct rotational phase to maximize warhead effectiveness. A directional warhead is one which explodes directionally, that is, in a generally radial direction as opposed to omnidirectionally. With a rolling projectile, a directional explosion directed away from the intended target at the closest point of approach would be substantially useless. If the projectile had trigger means which was controllable by means of a signal from the transmitter/-receiver, and with knowledge of the roll phase, it would be possible to ensure that the explosive would be directed toward the target and not in some harmless direction.

It should now be clear that only passive reading means are carried on board the projectile. The same optical area at the back of the projectile is used both to retro reflect energy which is employed to collect coded information, and to receive information for use in the projectile guidance means. Thus a single channel accomplishes both, creating flight characteristic information and receiving guidance information. Because the retro reflective system of the invention is so simple, it is relatively straightforward to harden it for the relatively severe G levels incurred with bullet firings or cannon launches.

Figure 3:
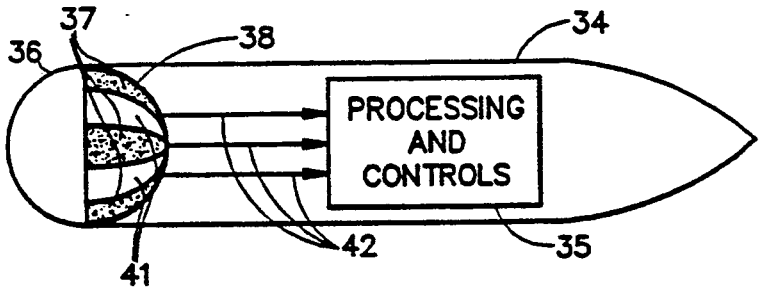
FIG. 3 shows an alternative embodiment in schematic form.
Figure 4:
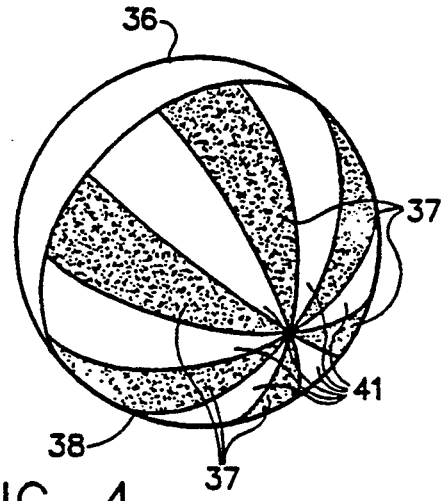
FIG. 4 shows the Luneburg ball lens of FIG. 3 at a partially rotated orientation.
Figure 5:
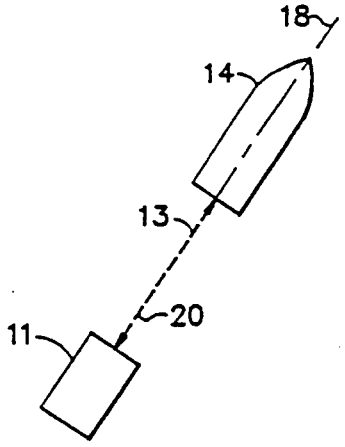
FIG. 5 is a schematic diagram showing the transmitted signal and projectile axes aligned.
Figure 6:
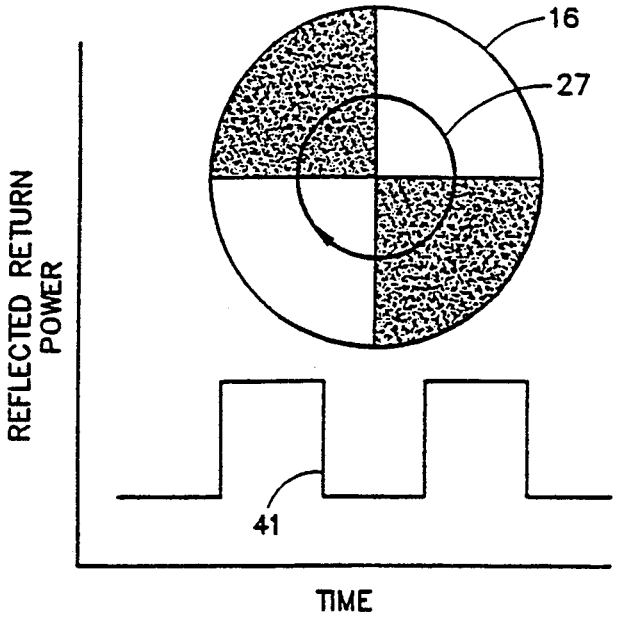
FIG. 6 is a waveform of the modulated reflected return signal with the alignment of FIG. 5.
Figure 7:
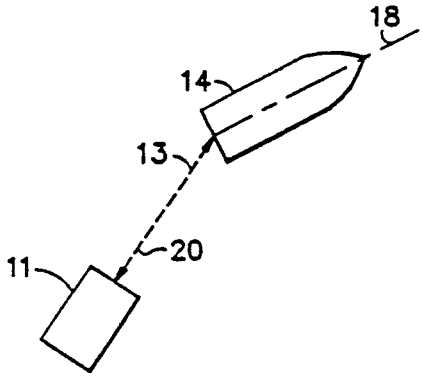
FIG. 7 is a schematic diagram showing the projectile axis canted with respect to the transmitted signal axis.
Figure 8:
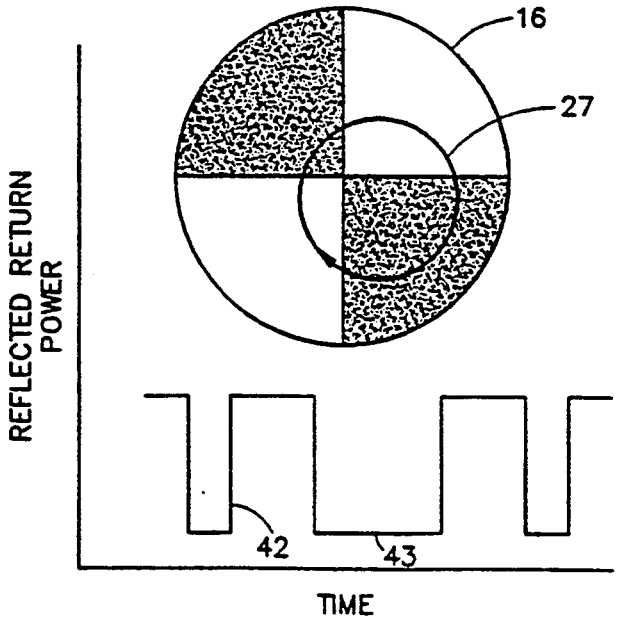
FIG. 8 is a waveform of the modulated reflected return signal with the orientation of FIG. 7.

An alternative embodiment is shown in FIGS. 3 and 4. The signal origin of the transmitter/receiver and the signal beam are the same as shown in FIG. 1 and are not repeated here. The processing and controls block 35 in projectile 34 is also the same. However, the lens, reticle and detector of the previous embodiment are combined into a single element constructed as a selectively surface-coated ball lens 36. This lens may be referred to as a Luneburg lens. This lens retro reflects over a greater angle of difference between the missile and transmitter and thus would enable continued communications between the transmitter/receiver and the projectile, even after the projectile has passed over its apogee and it heading downwardly. That portion of hemisphere 38 of lens 36 located inside the projectile would be coated with silver or equivalent material to provide selective reflective segments 37. Alternating segments 41 could be covered with detector material which would then be connected by means of lines 42 to processing and controls block 35. Ball lens 36 is fixed to projectile 34 as is the optical system of FIGS. 1 and 2, so that as the projectile rolls, the modulation effects of the reticle pattern produce the desired signals. The reticle shown in FIG. 4 is by way of example only, as is true of the reticle pattern of FIG. 2.

It is also possible to employ a combination of the FIGS. 1 and 3 embodiments where a separate detector 17 is used but ball lens 36 performs the function of lens 15 and reticle 16 of FIG. 1.

Another alternative in controlling the projectile is that two separate data streams could be transmitted over beam 13, one of which will be partially reflected by reticle 16 and provide the desired information with respect to the flight characteristics of the projectile, while the other data stream includes control information and passes through the transmissive segments of the reticle as previously described. The information provided by the two data streams could be frequency distinct and filters 19 (FIG. 2) within the projectile could then be-used to separate that information, so that only the desired control information would pass through the optical system to the detector and the information in the other beam would be reflected back to the transmitter/-receiver.

As another alternative, the reticle coating could itself be frequency dependent. The normal signal employed to determine flight characteristics could be of a frequency as described, being reflected by reflective segments of the reticle and passed on to the processing and controls by the transmissive segments. Control signals could be on a carrier which is of a different frequency to which the entire reticle is transparent. This would allow signal beam 13 and a separate control signal to be simultaneously transmitted to the projectile to possibly make the projectile more responsive to control signals.

In view of the above description, it is likely that modifications and improvements will occur to those skilled in the art which are within the scope of the accompanying claims. The system has been described generally as an optical system employing a laser beam for communications between the transmitter/receiver and the projectile. The system is not limited to optics only.

What is claimed is:

1. Apparatus for obtaining flight characteristics of and controlling a rolling projectile, said apparatus comprising:

a transmitter/receiver located on a platform and adapted to transmit signals and to receive signals;

guidance command signal computation means on said platform and coupled to said transmitter/receiver; and signal receiving means on said projectile, said signal receiving means being accessible to transmitted signals from said transmitter/receiver, said signal receiving means comprising:

collecting lens means at one end of said projectile;

a reticle having normally reflective and normally transmissive segments in a predetermined pattern, said reticle being positioned inwardly from the externally exposed surface of said lens means;

said reticle being positioned off of the projectile roll axis, with its optical centerline positioned at an angle with respect to the projectile roll axis; and detector means positioned inwardly of the exposed surface of said lens means and adapted to detect signals transmitted through said lens means and not reflected by said reflective segments of said reticle;

whereby said computation means provided information as to roll rate, roll phase and pitch attitude of said projectile.

2. The apparatus recited in claim 1, wherein:

said signal receiving means is accessible to transmitted signals from said transmitter/receiver from the back of said projectile;

said collecting lens is located at the back end of said projectile;

said reticle is positioned forwardly of the rear surface of said lens means; and said detecter means is positioned forwardly of the rear surface of said lens means.

3. The apparatus recited in claim 1, wherein said signal receiving means further comprises:

processing and control means within said projectile and connected to said detector means, said processing and control means having output control signals; and means for changing selected flight characteristics of said projectile in response to said control signals from said processing and control means.

4. The apparatus recited in claim 3, wherein said lens means, said reticle means and said detector means comprise a single spherical lens having detecting and transmissive segments on its inner hemisphere.

5. The apparatus recited in claim 1, wherein the plane of said reticle is at an angle with respect to the optical axis between said lens means and said detector means.

6. The apparatus recited in claim 1, wherein the center of said reticle is positioned off the optical axis between said lens means and said detector means.

7. The apparatus recited in claim 1, wherein said lens means and said reticle means comprise a single spherical lens having reflective and transmissive segments on its inner hemisphere.

* * * * *